US006564780B2

(12) United States Patent
Hanai et al.

(10) Patent No.: US 6,564,780 B2
(45) Date of Patent: May 20, 2003

(54) DIAGNOSTIC APPARATUS AND METHOD FOR FUEL VAPOR PURGE SYSTEM

(75) Inventors: Shuichi Hanai, Toyota (JP); Tokiji Ito, Toyota (JP); Noriyuki Iden, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 82 days.

(21) Appl. No.: 09/859,450

(22) Filed: May 18, 2001

(65) Prior Publication Data

US 2001/0054415 A1 Dec. 27, 2001

(30) Foreign Application Priority Data

Jun. 23, 2000 (JP) ..... 2000-189635

(51) Int. Cl.[7] ..... F02M 33/02
(52) U.S. Cl. ..... 123/520; 123/198 D
(58) Field of Search ..... 123/520, 198 D, 123/519, 518, 516

(56) References Cited

U.S. PATENT DOCUMENTS

| | | | | |
|---|---|---|---|---|
| 5,671,718 A | | 9/1997 | Curran et al. | |
| 6,220,230 B1 | * | 4/2001 | Kawamura et al. | 123/520 |
| 6,289,880 B1 | * | 9/2001 | Yamaguchi et al. | 123/520 |
| 6,405,718 B1 | * | 6/2002 | Yoshioka et al. | 123/198 D |

FOREIGN PATENT DOCUMENTS

| | | |
|---|---|---|
| JP | A 8-61164 | 3/1996 |
| JP | B2 2635270 | 4/1997 |
| JP | B2 2759908 | 3/1998 |
| JP | 2001-041115 | 2/2001 |

* cited by examiner

*Primary Examiner*—Henry C. Yuen
*Assistant Examiner*—Mahmoud Gimie
(74) *Attorney, Agent, or Firm*—Oliff & Berridge, PLC

(57) ABSTRACT

In a diagnostic apparatus and method for a fuel vapor purge system in which fuel vapor generated in a fuel tank trapped in a chamber is purged into an intake passage of an internal combustion engine through a purge path, a first change in a pressure of the purge path is measured after creating a pressure difference between the inside and outside of the purge path and sealing the purge path, and a second change in pressure that varies with an amount of fuel vapor generated in the fuel tank is measured while the purge path is sealed for a first period of time after an atmospheric pressure is introduced into the purge path. Then, it is determined whether leakage is present in the purge path, based on the first change and the second change in the pressure of the purge path. Before the measurement of the first and second pressure changes, a third change in the pressure that varies with an amount of fuel vapor generated in the fuel tank is measured while the purge path is sealed for a second period of time after the atmospheric pressure is introduced into the purge path before the pressure difference is created. The leakage diagnosis is inhibited when the third change in the internal pressure is greater than a predetermined value, and the leakage diagnosis is permitted when the third change is equal to or less than the predetermined value.

8 Claims, 3 Drawing Sheets

DIAGNOSTIC APPARATUS AND METHOD FOR FUEL VAPOR PURGE SYSTEM

INCORPORATION BY REFERENCE

The disclosure of Japanese Patent Application No. 2000-189635 filed on Jun. 23, 2000, including the specification, drawings and abstract, is incorporated herein by reference in its entirety.

BACKGROUND OF THE INVENTION

1. Field of Invention

The invention relates to a diagnostic apparatus and method for a fuel vapor purge system for use in an internal combustion engine installed in a motor vehicle, such as, for example, an automobile.

2. Description of Related Art

In the internal combustion engine having the aforementioned fuel vapor purge system, fuel vapor may leak from a canister or a fuel tank into the ambient air if a hole or holes is/are formed in a pipe defining the purge path, or the pipe is disengaged or detached from another component for some reason. In order to detect this situation, it is desirable to automatically detect leakage of fuel vapor from the purge path of the fuel vapor purge system including the canister and the fuel tank.

To meet this requirement, a system for diagnosing the fuel vapor purge system has been proposed in which leakage in the purge path is detected based on a pressure change within the purge path after a negative pressure of the intake system of the engine, which is lower than the atmospheric pressure, is introduced into the purge path and the purge path is then sealed, and also based on a pressure change within the fuel tank due to fuel vapor generated in the tank, which change is measured when the purge path is subjected to the atmospheric pressure and is sealed in this state. When diagnosis of the purge path is effected by detecting a change in the internal pressure of the purge path with time while the purge path is subjected to a negative pressure, it is impossible to determine whether an increase in the pressure within the purge path is caused by the atmospheric pressure entering the purge path through a hole(s) or a crack(s) in a pipe defining the purge path, or the pressure increase is caused by a large amount of fuel vapor generated in the fuel tank. Accordingly, this system is adapted to measure a pressure change before a negative pressure is introduced into the purge path, and also measure a pressure change after the atmospheric pressure is introduced into the purge path.

The aforementioned diagnostic apparatus for the fuel vapor purge system is adapted to measure a change in the fuel tank pressure due to fuel vapor generated in the tank, after a negative pressure is introduced into the purge path for detecting leakage in the purge path. Accordingly, a diagnostic operation to detect leakage in the purge path is performed even when a large amount of fuel vapor is generated within the fuel tank and it is difficult to accurately detect leakage in the purge path. In this case, however, the leakage detection under the negative pressure is an unnecessary step, which results in an increase in time required for diagnosing the fuel vapor purge system.

Furthermore, in the aforementioned fuel vapor purge system in which the fuel tank and the canister are always held in communication with each other, it is necessary to seal the purge path by closing a pressure block valve and a purge control valve so as to measure a pressure change in the fuel tank due to fuel vapor generated in the tank. During the measurement of the tank pressure change, therefore, a purging operation is suspended, in other words, purge cut is effected. If a diagnostic operation to detect leakage in the purge path is performed even when a large amount of fuel vapor is generated in the fuel tank and accurate detection of leakage is difficult, purging is suspended or stopped for an increased period of time, and the fuel vapor purge system may fail to ensure a required amount of fuel vapor to be purged, which should remain in the canister.

SUMMARY OF THE INVENTION

It is an object of one aspect of the invention to provide a diagnostic apparatus and method for a fuel vapor purge system, which is able to suppress or avoid an increase in the time required for diagnosing the system by eliminating an unnecessary detecting or determining step(s).

To accomplish the above and/or other objects, one aspect of the invention provides a diagnostic apparatus and method for a fuel vapor purge system wherein fuel vapor generated in a fuel tank is trapped in a chamber (e.g., a canister), and the fuel vapor trapped in the chamber is purged into an intake passage of an internal combustion engine through a purge path that includes the fuel tank. A controller of the diagnostic apparatus measures a first change in an internal pressure of the purge path after creating a pressure difference between the inside and outside of the purge path and sealing the purge path, and measures a second change in the internal pressure that varies with an amount of fuel vapor generated in the fuel tank, which change is measured while the purge path is sealed for a first predetermined period of time after an atmospheric pressure is introduced into the purge path in which the pressure difference was created. The controller then performs leakage diagnosis to determine whether leakage is present in the purge path, based on the first change and the second change in the internal pressure of the purge path. Furthermore, before the measurements of the first and second pressure changes, a third change in the internal pressure that varies with an amount of fuel vapor generated in the fuel tank is measured while the purge path is sealed for a second predetermined period of time after an atmospheric pressure is introduced into the purge path before the pressure difference is created. The leakage diagnosis is inhibited from being performed when a result of measurement of the third change in the internal pressure is greater than a predetermined value, and is allowed to be performed when the result of measurement of the third change is equal to or less than the predetermined value.

According to the aspect of the invention described above, a change in the pressure that varies with an amount of fuel vapor generated in the fuel tank is measured while the purge path is sealed for the second predetermined period of time after the atmospheric pressure is introduced into the purge path before the pressure difference is created. The leakage diagnosis to determine the presence of leakage in the purge system is inhibited if the measurement result is greater than the predetermined value, and is permitted if the measurement result is equal to or less than the predetermined value. Accordingly, when a large amount of fuel vapor is generated in the fuel tank, and it is difficult to accurately detect leakage in the purge path, unnecessary steps of measuring a change in the tank pressure with the pressure difference being provided, and measuring a change in the pressure due to fuel vapor generated in the tank after the creation of the pressure difference, can be advantageously eliminated, resulting in an otherwise possible increase in the time required for accomplishing the diagnosis.

BRIEF DESCRIPTION OF THE DRAWINGS

The foregoing and/or further objects, features and advantages of the invention will become apparent from the following description of preferred embodiments with reference to the accompanying drawings, in which like numerals are used to represent like elements and wherein.

DETAILED DESCRIPTION OF PREFERRED EMBODIMENTS

Hereinafter, a diagnostic apparatus for a fuel vapor purge system according to a preferred embodiment of the invention will be described with reference to the drawings.

Figure 1:
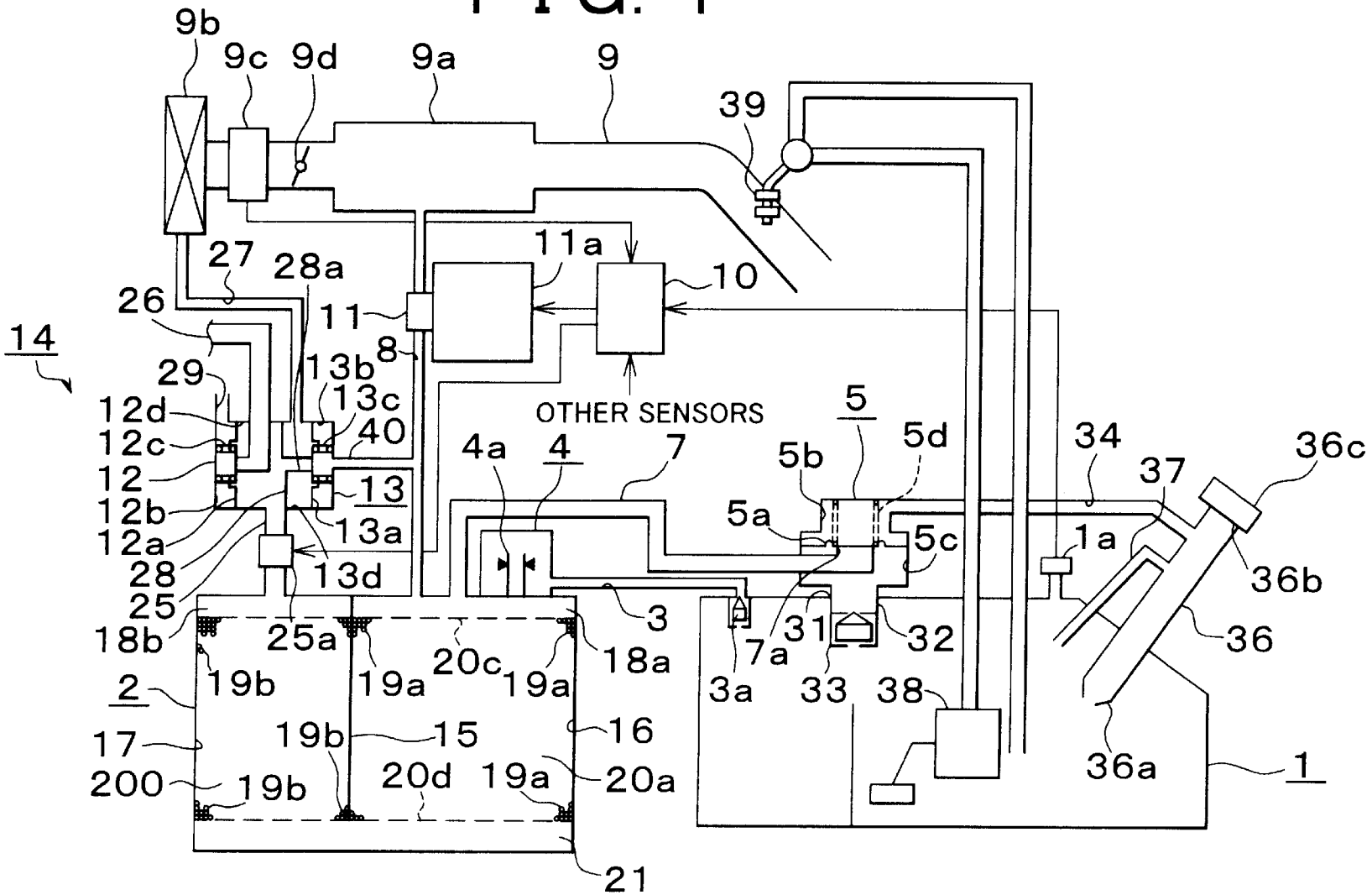
FIG. 1 is a schematic diagram illustrating a whole fuel vapor purge system according to a preferred embodiment of the invention.

FIG. 1 is a schematic diagram illustrating the whole fuel vapor purge system according to the preferred embodiment of the invention. The fuel vapor purge system is mounted for use with, e.g., a gasoline engine installed in a motor vehicle.

A fuel vapor conduit 3 for guiding the fuel vapor generated in a fuel tank 1 of the gasoline engine into a canister or chamber 2 is open to and connected at its one end to the fuel tank 1 via a float 3*a*. The other end of the fuel vapor conduit 3 is connected to the canister 2 via a pressure buffer chamber 4 disposed on top of the canister 2. An orifice 4*a* serving as a flow resistor is provided within the pressure buffer chamber 4. The orifice 4*a* permits constant communication between the fuel tank 1 and the canister 2 so as to prevent rapid transmission of the pressure change within the canister 2 into the fuel tank 1, and to gradually equalize the pressure within the fuel tank 1 with the internal pressure of the canister 2.

The fuel tank 1 is also provided with a differential pressure valve 5 adapted to be open during refueling. The differential pressure valve 5 is connected to the canister 2 through a breather passage 7. Accordingly, when the differential pressure valve 5 is open during refueling, fuel vapor within the fuel tank 1 is introduced into the canister 2 through the breather passage 7.

The interior of the canister 2 communicates, through a purge passage 8, with a surge tank 9*a* that forms a part of an intake passage 9. The purge passage 8 is provided with a purge control valve 11. The purge control valve 11 is driven to one of open and closed positions by a drive circuit 11*a* in response to a control signal from an ECU (Electronic Control Unit) 10 in the form of a microcomputer.

The purge control valve 11 may operate, under purge control, to adjust the amount of fuel supplied by purging from the canister 2 to the engine intake passage 9. In failure diagnosis control, the purge control valve 11 may shut off and open the purge passage 8. For example, a vacuum switching valve (VSV) or the like is employed as the purge control valve 11.

The interior of the canister 2 is divided by a vertically extending partition plate 15 into two chambers, namely, a main chamber 16 located below the pressure buffer chamber 4, and a sub chamber 17 located below an ambient-air control valve 14 and having a smaller volume than that of the main chamber 16. Air layers 18*a*, 18*b* are respectively formed in the upper portions of the main chamber 16 and the sub chamber 17. Adsorbent layers 20*a*, 20*b* filled with activated charcoal adsorbents 19*a*, 19*b* are respectively formed under the air layers 18*a*, 18*b*.

Filters 20*c*, 20*d* are provided on top of and below the adsorbent layers 20*a*, 20*b*, respectively, and the activated charcoal adsorbents 19*a*, 19*b* fill the space between the filters 20*c*, 20*d*. The space located under the filter 20*d* provides a diffusion chamber 21, through which the main chamber 16 and the sub chamber 17 communicate with each other.

The breather passage 7 is connected at one end thereof to the upper surface of the canister 2 at the top of the main chamber 16. Likewise, the purge passage 8 is connected to the main chamber 16 on the left side of the opening position of the breather passage 7 as viewed in FIG. 1.

In a state where the purge control valve 11 is held in an open position, and a pressure lower than the atmospheric pressure is being introduced into the canister 2, the space within the purge passage 8 sequentially communicates with the main chamber 16, pressure buffer chamber 4, fuel vapor conduit 3 and the fuel tank 1 in this order. The space within the breather passage 7 also communicates with the main chamber 16, which means that the breather passage 7 shares the same space with the purge passage 8. In this specification, the pressure lower than the atmospheric pressure will be referred to as "negative pressure", and the pressure higher than the atmospheric pressure will be referred to as "positive pressure". Thus, a purge path is formed by the shared spaces within the fuel vapor purge system which communicate with each other while a negative pressure is being applied to the canister 2. The diagnostic apparatus for the fuel vapor purge system according to this embodiment diagnoses the fuel vapor purge system by determining whether the purge path has a leakage.

A ventilation port 25 is also formed above the top surface of the canister 2 located above the sub chamber 17. A pressure block valve 25*a* is disposed in the middle portion of the ventilation port 25. The pressure block valve 25*a* is normally open, but is controlled by the ECU 10 to be opened and closed during a diagnosing process as described below. For example, a VSV (vacuum switching valve) is used as the pressure block valve 25*a*.

The ambient-air control valve 14 is provided in series with the pressure block valve 25*a* so as to communicate with the ventilation port 25. The ambient-air control valve 14 includes an ambient-air release valve 12 and an ambient-air introduction control valve 13 which are oppositely located in the lateral direction as viewed in FIG. 1. An ambient-air pressure chamber 12*b* is formed on the left side of a diaphragm 12*a* provided in the ambient-air release valve 12 as viewed in FIG. 1, and a negative pressure chamber 13*b* is formed on the right side of a diaphragm 13*a* provided in the ambient-air introduction control valve 13 as viewed in FIG. 1. The space interposed between these two diaphragms 12*a* and 13*a* is divided into two pressure chambers by a partition wall 28. One of those two pressure chambers is a positive pressure chamber 12*d* of the ambient-air release valve 12, and the other is an atmospheric pressure chamber 13*d* of the ambient-air introduction control valve 13.

A pressure port 28*a* is formed by a part of the partition wall 28, and the opening at the distal end of the pressure port 28*a* is allowed to be closed by the diaphragm 13*a*. An ambient air conduit 27 communicates with the atmospheric pressure chamber 13*d*. The diaphragm 13*a* is pressed against the opening at the distal end of the pressure port 28*a* due to the biasing force of a spring 13*c* provided in the negative pressure chamber 13*b*, so that the ambient-air introduction control valve 13 is normally kept in the closed state.

The negative pressure chamber 13*b* is connected via the negative pressure conduit 40 to the purge passage 8 at a position between the purge control valve 11 and the canister 2. With this arrangement, the pressure generated in the surge tank 9*a* of the intake passage 9 can be introduced into the negative pressure chamber 13*b* through the purge control valve 11. While the engine is running, and purging is being carried out, a negative pressure produced in the surge tank 9*a* as the intake air is drawn into the engine is introduced into the negative pressure chamber 13*b*. When the negative pressure within the negative pressure chamber 13*b* becomes equal to or greater than the pressing force of the spring 13*c*, the diaphragm 13*a* is spaced away from the opening of the pressure port 28*a* such that the ambient-air introduction control valve 13 is brought into the open state and kept in this state. While the engine is stopped, or while the purge control valve 11 is closed even when the engine is running, on the other hand, the pressure in the vacuum chamber 13*b* is made equal to the pressure in the canister 2. Thus, the ambient-air introduction control valve 13 cooperates with the ambient-air release valve 12 to control the pressure within the canister 2 to be held in a predetermined range with respect to the atmospheric pressure.

With the above arrangement, when the fuel adsorbed in the canister 2 is purged (discharged) into the intake passage 9 due to the negative pressure generated in the surge tank 9*a* during running of the engine, the outside air or atmosphere can be introduced into the sub chamber 17 of the canister 2 through the ambient-air introduction passage 27 and the ventilation port 25. With the outside air thus introduced, the fuel vapor adsorbed by the activated charcoal adsorbents 19*a*, 19*b* in the main and sub chambers 16, 17 flows toward the purge passage 8, and is then purged into the intake air flowing through the surge tank 9*a*.

In order to measure the amount of pressure change in the fuel tank 1, namely, the amount of fuel vapor generated in the tank 1, after introducing a negative pressure for diagnosis of the fuel vapor purge system during an operation of the engine, the pressure block valve 25*a* is opened while the purge control valve 11 is kept closed, so that pressures in the canister 2 and the fuel tank 1 are returned to the atmospheric pressure. Since the ambient-air introduction control valve 13 is held in the open state at this time, a large amount of the outside air is introduced into the canister 2 through the ambient-air introduction control valve 13, and further into the fuel tank 1 through the orifice 4*a*. The pressure within the canister 2 sharply increases to be close to the atmospheric pressure, and the pressure within the fuel tank 1 also increases with a certain delay. As the ambient-air introduction control valve 13 is held in the open state, the pressures in the canister 2 and the fuel tank 1 can be returned to the atmospheric pressure in a relatively short time.

An ambient-air release port 29, which communicates with the ambient-air pressure chamber 12*b* of the ambient-air release valve 12, is formed in the upper part of the ambient-air control valve 14, such that the interior of the ambient-air pressure chamber 12*b* is constantly kept at the atmospheric pressure. The ambient-air control valve 14 is provided with an ambient-air discharge port 26 for guiding gas whose fuel components have been trapped in the canister 2, to the outside of the vehicle (i.e., to the atmosphere). The opening formed at one end of the ambient-air discharge port 26 is adapted to be closed by the diaphragm 12*a* of the ambient-air release valve 12. The diaphragm 12*a* is pressed against the opening of the ambient-air discharge port 26 due to the biasing force of a spring 12*c* disposed in the ambient-air chamber 12*b*. Thus, the ambient-air release valve 12 is held in the closed state until the internal pressure of the canister 2 becomes equal to or higher than a specified or predetermined level.

If a pressure is applied from the breather passage 7 into the canister 2 during refueling, the pressure in the positive pressure chamber 12*d* of the ambient-air release valve 12 is increased. When the difference between the pressure in the positive pressure chamber 12*d* and the atmospheric pressure introduced from the ambient-air release port 29 into the ambient-air pressure chamber 12*b* reaches a specified or predetermined level, the ambient-air release valve 12 is opened. As a result, gas, which has passed through the main chamber 16 and the sub chamber 17 in which fuel vapor was adsorbed and removed, is discharged to the outside through the ventilation port 25 and the ambient-air discharge port 26.

An insertion hole 31 is formed through the top wall of the fuel tank 1. A cylindrical breather pipe 32 forming a part of the breather passage 7 is inserted into the insertion hole 31 and fixed in position. A float valve 33 is formed at the bottom of the breather pipe 32. The differential pressure valve 5 is provided above the fuel tank 1 so as to cover an opening 32*a* at the upper end of the breather pipe 32. The interior of the differential pressure valve 5 is divided by a diaphragm 5*a* into a first pressure chamber 5*b* disposed above the diaphragm 5*a*, and a second pressure chamber 5*c* disposed below the diaphragm 5*a*. Under the biasing force of a spring 5*d* provided in the first pressure chamber 5*b*, the diaphragm 5*a* is pressed against an opening 7*a* at the upper end of the breather passage 7 entering the second pressure chamber 5*c*. Thus, the opening 7*a* at the upper end of the breather passage 7 is adapted to be closed by the diaphragm 5*a*.

The first pressure chamber 5*b* of the differential pressure valve 5 communicates via a pressure passage 34 with the upper portion of a fuel fill pipe 36 provided in the fuel tank 1. A restriction 36*a* is formed at the lower end of the fuel fill pipe 36. In order to fill the tank 1 with fuel, cap 36*c* is removed. When the supplied fuel passes through the restriction 36*a*, the flow direction of the fuel vapor within the fuel fill pipe 36 is restricted to the direction from a filler opening 36*b* to the fuel tank 1. Accordingly, fuel vapor can be prevented from leaking from the filler opening 36*b* to the outside of the vehicle. A circulation pipe 37 is provided which allows communication between the respective upper portions of the fuel tank 1 and the fuel fill pipe 36 with each other. Thus, the fuel vapor within the fuel tank 1 is circulated between the fuel tank 1 and the fuel fill pipe 36 during refueling, thus enabling smooth fuel supply.

A pressure sensor 1*a* for detecting the pressure within the fuel tank 1 is provided at the upper portion of the fuel tank 1. In this embodiment, the pressure sensor 1*a* serves to detect a pressure relative to the atmospheric pressure as a reference pressure. A detection signal of the pressure sensor 1*a* is transmitted to the ECU 10 that performs purge control and diagnosis control. Signals of various sensors, such as an airflow meter 9*c* disposed in the intake passage 9, are also transmitted to the ECU 10.

The fuel vapor purge system constructed as described above functions in the manner as described below.

When the internal pressure of the fuel tank 1 is increased to a level that is higher than the pressure within the canister 2 due to evaporation of fuel within the fuel tank 1, a flow of fuel vapors in the direction from the fuel tank 1 toward the canister 2 is formed within the fuel vapor conduit 3. Thus, the fuel vapor in the fuel tank 1 is introduced into the canister 2 through the orifice 4*a* of the pressure buffer chamber 4. Since the first and second pressure chambers 5*b* and 5*c* of the differential pressure valve 5 have the same internal pressure, the differential pressure valve 5 is held in the closed position, and thus the breather passage 7 is closed.

When the fuel vapor reaches the interior of the canister 2 after passing through the fuel vapor conduit 3, its fuel components are first trapped by the activated charcoal adsorbent 19*a* filling the adsorbent layer 20*a* of the main chamber 16. The fuel vapor then passes through the adsorbent layer 20*a* and reaches the diffusion chamber 21. The fuel vapor further travels through the diffusion chamber 21 into the sub chamber 17 where the fuel components that have not been trapped by the adsorbent layer 20*a* of the main chamber 16 are trapped in the adsorbent layer 20*b*. Thus, the fuel vapor flows along the U-shaped traveling path within the canister 2, so that the fuel vapor is brought into contact with the activated charcoal adsorbents 19*a*, 19*b* of the adsorbent layers 20*a*, 20*b* for an extended period of time. Consequently, the fuel components are effectively trapped.

The resultant gas having most of the fuel components trapped by the activated charcoal adsorbents 19*a*, 19*b* of the adsorbent layers 20*a*, 20*b* passes through the ambient-air release valve 12, and is discharged to the outside through the discharge port 26. At this time, the negative pressure chamber 13*b* of the ambient-air introduction control valve 13 has a positive internal pressure that is higher than the internal pressure of the atmospheric pressure chamber 13*d*, and therefore the ambient-air introduction control valve 13 does not open. Accordingly, fuel vapor does not leak to the outside of the vehicle through the ambient-air introduction control valve 13 and the ambient-air conduit 27.

Next, the fuel components trapped in the canister 2 are supplied to the intake passage 9 in the following manner. Upon the start of the engine, a negative pressure is developed in the vicinity of an opening of the purge passage 8 that faces the surge tank 9*a*. If purge control is initiated in this state and the purge control valve 11 is opened, the ambient-air introduction control valve 13, which receives the negative pressure through the valve 11, is also opened. As a result, a flow or stream of fuel vapors in the direction from the canister 2 toward the surge tank 9*a* is formed within the purge passage 8 every time the purge control valve 11 is driven to an open position in response to a control signal from the ECU 10.

Accordingly, the interior of the canister 2 is subjected to a negative pressure, so that air is introduced from the ambient-air conduit 27 into the sub chamber 17 of the canister 2. As a result, the air thus introduced causes the fuel components adsorbed by the activated charcoal adsorbents 19*a*, 19*b* to be separated therefrom, and that air absorbs the fuel components thus separated. The thus introduced air guides the fuel vapor into the purge passage 8 and discharges it into the surge tank 9*a* through the purge control valve 11. In the surge tank 9*a*, the fuel vapor is mixed with the intake air that has passed through the air cleaner 9*b*, airflow meter 9*c* and the throttle valve 9*d*. The mixture is then supplied into cylinders (not shown) of the engine. The fuel vapor thus mixed with the intake air is burned in each cylinder, together with fuel delivered from the fuel tank 1 through a fuel pump 38 and emitted from a fuel injection valve 39.

In the case where the fuel tank 1 is cooled while the engine is stopped during parking of the vehicle for hours, substantially no fuel vapor is generated in the fuel tank 1, and the pressure in the fuel tank 1 becomes relatively lower than that in the canister 2. In this case, the pressure within the fuel tank 1 is transferred to the negative pressure chamber 13*b* through the fuel vapor conduit 3, pressure buffer chamber 4, orifice 4*a*, and the canister 2. When the negative pressure thus applied to the negative pressure chamber 13*b* becomes lower than a predetermined level (i.e., when the magnitude of the negative pressure exceeds a predetermined value), the diaphragm 13*a* is spaced apart from the opening of the pressure port 28*a* against the bias force of the spring 13, so that the ambient-air introduction control valve 13 is opened. Consequently, the ambient air flows into the canister 2 through the ambient-air introduction control valve 13, and fuel vapor in the canister 2 is returned to the fuel tank 1 through the orifice 4*a* and the fuel vapor conduit 3.

Figure 2:
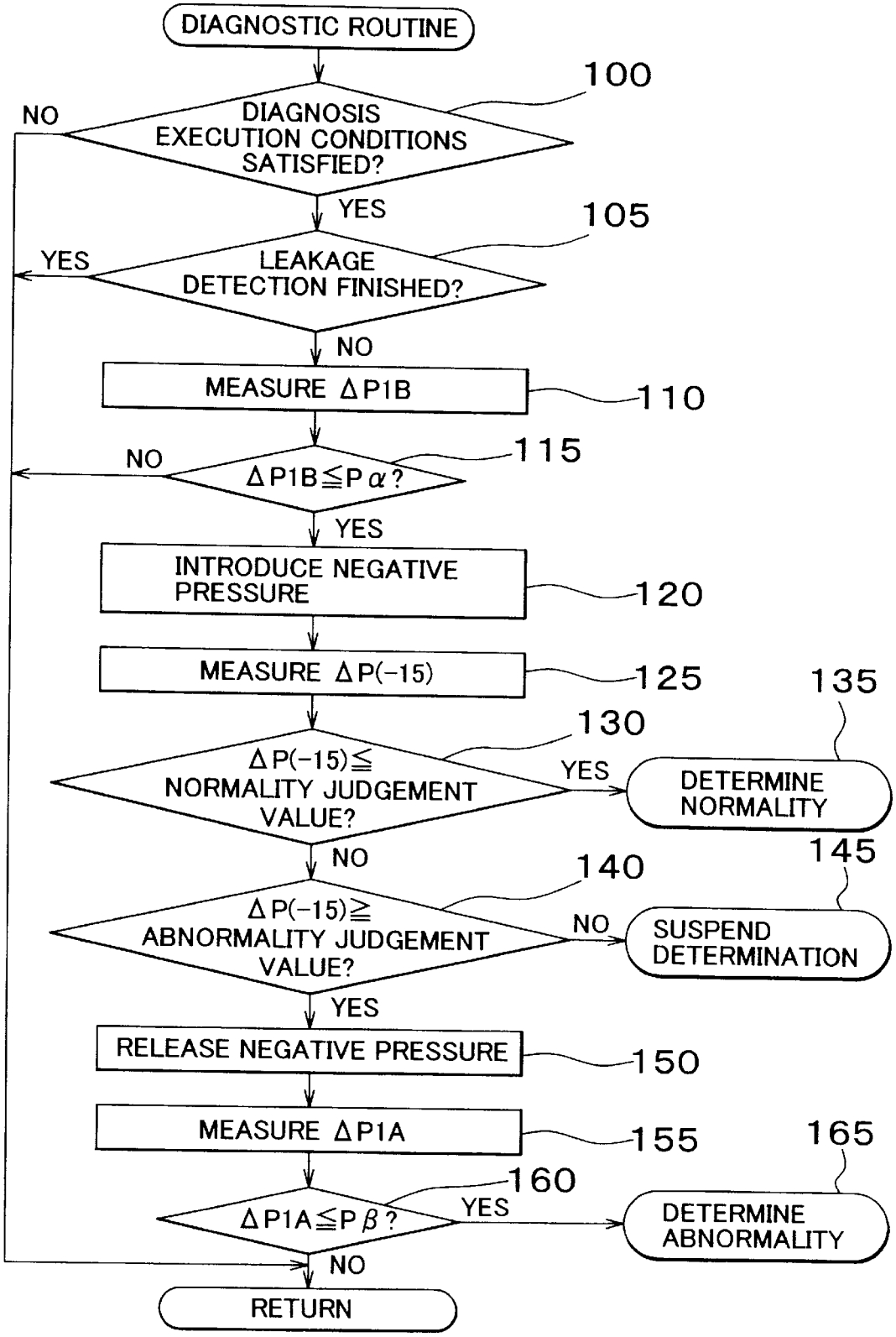
FIG. 2 is a flowchart of a diagnostic routine to be executed by an ECU of the fuel vapor purge system shown in FIG. 1.
Figure 3:
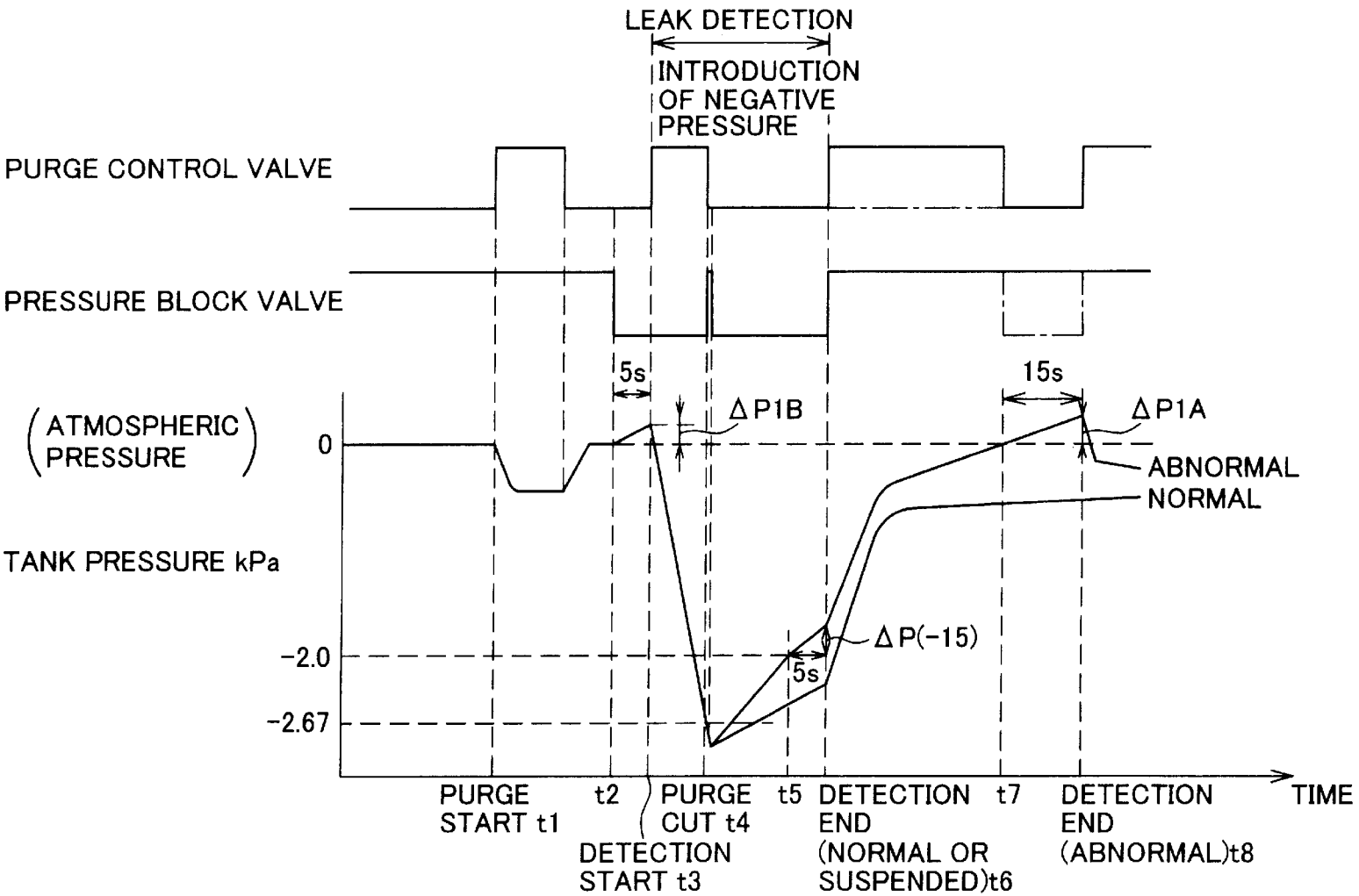
FIG. 3 is a timing chart illustrating an example of the diagnostic routine shown in FIG. 2.

The diagnostic process executed by the ECU 10 for diagnosing the fuel vapor purge system or detecting a failure in the system will now be described referring to the flowchart as shown in FIG. 2. Also, the timing chart of FIG. 3 illustrates an example of the diagnostic process. In the diagnostic process as described below, the internal pressure of the fuel tank is to be regarded as a pressure relative to the atmospheric pressure as a reference pressure.

The diagnostic process of this embodiment is implemented if predetermined conditions for executing the diagnostic process are established after necessary initialization is performed upon turn-on of a power supply for the ECU 10. The conditions for executing the diagnostic process are established or satisfied when the current operating state of the engine or vehicle permits the intake pressure (i.e., negative pressure of the intake air) to be introduced into the fuel vapor purge system for the purpose of diagnosis. For example, the conditions may be established when no abnormality is found in the pressure sensor 1*a* and other sensors and the operation of the engine becomes stable upon a lapse of a certain time after the start of the engine.

The flowchart of FIG. 2 illustrates a diagnostic routine for detecting a failure in the fuel vapor purge system. This routine is cyclically executed by the ECU 10 at certain time intervals.

Upon start of the diagnostic routine of FIG. 2, step 100 is initially executed to determine whether diagnosis execution conditions are satisfied. More specifically, the conditions to be satisfied in step 100 include: (1) purging is being executed, (2) the altitude is equal to or less than a predetermined level (for example, 2400 m), i.e., the atmospheric pressure is equal to or higher than a predetermined value, (3) the temperature of cooling water at the time of start of the engine is within a predetermined range (for example, the range of −10° C. to 35° C.), (4) the vehicle is not running on an uphill or downhill, and other conditions. An affirmative decision (YES) is obtained in step 100 only when all of these conditions are satisfied.

When step 100 determines that all conditions are satisfied, the process proceeds to step 105. If one or more of these conditions is/are not satisfied, the current cycle of the routine of FIG. 2 is terminated.

In step 105, it is determined whether a leakage determination (i.e., a determination as to whether there is a leakage in the purge path) has been made. If an affirmative decision (YES) is obtained in step 105, the current cycle of the routine is finished. If a negative decision (NO) is obtained, the process proceeds to step 110.

In step 110, the purge control valve 11 is closed and the pressure block valve 25*a* is opened so that the atmospheric pressure is introduced into the purge path. Subsequently, the pressure block valve 25*a* is closed to seal the purge path, and a change (i.e., an increase) ΔP1B of the tank pressure within a second predetermined period (for example, 5 seconds) due to fuel vapor generated before introduction of the negative pressure into the purge path for diagnosis is measured.

Referring to the time chart of FIG. 3, purging starts at time t1, and the purge path is sealed at time t2 so that the internal pressure of the fuel tank 1 changes from 0 kPa as fuel vapor is generated in the fuel tank 1. This change ΔP1B in the tank pressure is measured at time t3.

In step 115, it is determined whether the tank pressure change ΔP1B is equal to or less than a predetermined value Pα. If a negative decision (NO) is obtained in step 115, namely, if the tank pressure change ΔP1B is greater than the predetermined value Pα, the routine is temporarily terminated. If an affirmative decision (YES) is obtained in step 115, namely, if the tank pressure change ΔP1B is equal to or less than the predetermined value Pα, the process proceeds to step 120.

In step 120, the purge control valve 11 is opened while the pressure block valve 25*a* is kept closed. Since the pressure block valve 25*a* is in the closed state, no ambient air is admitted to the fuel vapor purge system. With the purge control valve 11 being in the open state, a negative pressure in the surge tank 9*a* is introduced into the canister 2 through the purge passage 8. The negative pressure is also introduced into the fuel tank 1 through the canister 2, orifice 4*a*, and the fuel vapor conduit 3.

The aforementioned steps will be described with reference to the time chart of FIG. 3. After a negative pressure starts being introduced into the fuel vapor purge system at time t3, the internal pressure of the fuel tank 1 detected by the pressure sensor 1*a* drops sharply. If the purge control valve 11 is closed at time t4 in the above-described state, the purge path is sealed while being kept at the negative pressure. If no abnormality (e.g., no leakage) exists in the purge path, the pressure in the purge path gradually approaches a pressure level that is established when air and fuel vapor remaining in the path are brought into an equilibrium. If a leakage is present in the purge path, on the other hand, the pressure in the purge path rapidly increases to be close to the ambient air pressure (atmospheric pressure).

In step 125 of FIG. 2, a rate of change ΔP (−15) (mmHg/s or kPa/s) in the internal pressure of the purge path is measured for a predetermined period (for example, 5 seconds) starting at time t5 when the purge path pressure reaches a predetermined negative pressure (−2.0 kPa=−15 mmHg).

In the next step 130, it is determined whether the pressure change rate ΔP (−15) obtained in step 125 is equal to or less than a normality judgment value. If an affirmative decision (YES) is obtained in step 130, namely, if the pressure change rate ΔP (−15) is equal to or less than the normality judgment value Pa, the process proceeds to step 135. If a negative decision (NO) is obtained in step 130, namely, if the pressure change rate ΔP (−15) is greater than the normality judgment value Pa, the process proceeds to step 140. In step 135, it is determined that there is no failure or leakage due to, for example, a hole or holes, and the current cycle of the routine is terminated.

In step 140, it is determined whether the rate of pressure change ΔP (−15) is equal to or greater than an abnormality judgment value Pb. If the pressure change rate ΔP (−15) is less than the abnormality judgment value Pb ("NO" in step 140), the process proceeds to step 145 without making a judgement on the normality or abnormality of the fuel vapor purge system. If the pressure change rate ΔP (−15) is equal to or greater than the abnormality judgment value Pb ("YES" in step 140), the process proceeds to step 150. In step 145, the diagnosis of the fuel vapor purge system is suspended, and the current cycle of the routine is terminated.

In step 150, the purge control valve 11 is closed and the pressure block valve 25*a* is opened for introducing the atmospheric pressure into the purge path so as to release the negative pressure in the purge path.

In the next step 155, the purge control valve 11 and the pressure block valve 25*a* are closed so as to seal the purge path. Subsequently, a change ΔP1A in the internal pressure of the fuel tank 1 due to fuel vapor generated after introduction of the negative pressure into the purge path for diagnosis is measured for a first predetermined period (for example, 15 seconds). Referring to FIG. 3, the internal pressure of the fuel tank 1 changes from 0 kPa (0 mmHg) at time t7 as fuel vapor is generated in the fuel tank 1. Then, the amount of the pressure change ΔP1A within the fuel tank 1 is calculated at time t8.

In the following step 160, it is determined whether the pressure change amount ΔP1A is greater than a predetermined value Pβ (for example, 0.267 kPa=2 mmHg). Namely, this step is executed to determine whether the pressure change rate ΔP(−15) was greater than the abnormality judgment value (in step 140) because of leakage (due to a hole, or the like) in the purge path, or because of an excessively large amount of fuel vapor generated in the fuel tank 1. If it is determined that the pressure change amount ΔP1A is equal to or less than the predetermined value Pβ ("YES" in step 160), the process proceeds to step 165. If the pressure change amount ΔP1A is greater than the predetermined value Pβ ("NO" in step 160), the current cycle of the routine is terminated without making a judgment on the normality or abnormality of the fuel vapor purge system.

In step 165, the fuel vapor purge system is judged as being faulty or abnormal due to a hole in the purge path, and the leakage diagnosis is terminated. Then, the pressure block valve 25*a* is opened and the purge control valve 11 is opened at time t8 so as to start purging.

The fuel vapor purge system according to the above-described embodiment yields advantageous effects as follows.

In the illustrated embodiment, a pressure change caused by fuel vapor generated in the fuel tank 1 is measured over the second predetermined period of time while the purge path is kept at the atmospheric pressure before a negative pressure is introduced into the purge path to create a pressure difference between the inside and the outside of the purge path. If the measurement result exceeds the predetermined value, the leakage diagnosis is inhibited. If the measurement result is less than the predetermined value, the leakage diagnosis is allowed to be performed. In the case where a large amount of fuel vapor is generated in the fuel tank 1, thus making it difficult to determine whether leakage occurs in the purge path, unnecessary steps of, for example, measuring a change (or behavior) in the internal pressure of the fuel tank after the above-described pressure difference is created, and measuring a pressure change in the fuel tank due to fuel vapor generated in the tank, can be eliminated. Accordingly, the time required for diagnosing the fuel vapor purge system is prevented from being prolonged or extended by these steps.

In the illustrated embodiment, the second predetermined period for measuring a tank pressure change due to fuel vapor generated before the introduction of a negative pressure into the purge path is set to be smaller than the first predetermined period. Therefore, even if the operation to measure the tank pressure change over the second predetermined period is repeatedly executed, the overall time for diagnosing the fuel vapor purge system is not prolonged or extended. Thus, the unnecessary steps for detecting leakage are eliminated, and the diagnosis of the fuel vapor purge system can be accomplished with improved efficiency.

In this embodiment, the fuel tank 1 is constantly held in fluid communication with the canister 2. Since the leakage diagnosis is inhibited when a large amount of fuel vapor is generated in the fuel tank 1 and it is difficult to make a determination on leakage in the purge path, purging is interrupted or suspended for the purpose of the diagnosis for a reduced period of time, thus assuring a sufficient purge amount of fuel vapor in the canister 2.

In the diagnostic process of the illustrated embodiment, the fuel tank 1 and the canister 2 are connected via the orifice 4*a* such that the internal pressures in the fuel tank 1 and the canister 2 are always made equal to each other. Thus, the fuel tank 1 and the canister 2 are held in a similar coupling or communicating state at the time of the diagnosis of the fuel vapor purge system and at the time of measurement of pressure change ΔP1A, ΔP1B in the fuel tank 1. If it is determined in step 130 that the pressure change rate ΔP (−15) is equal to or less than the normal judgment value, there is no need to determine a failure by use of a pressure change ΔP1A after the diagnosis. Since the pressure change amount ΔP1A need not be measured in this case, the time required for the diagnosis of the fuel vapor purge system can be shortened, and an otherwise possible increase in the purge cut time can be suppressed (namely, the purge cut time can be reduced). This reduces a possibility that the amount of fuel vapor in the canister 2 becomes insufficient for purging.

While the invention has been described in the preferred embodiment for illustrative purposes only, it is to be understood that the invention may be otherwise embodied with various changes, modifications, or improvements, which may occur to those skilled in the art, without departing from the spirit and scope of the invention.

While the pressure sensor 1*a* is installed at the fuel tank 1 in the illustrated embodiment, the pressure sensor 1*a* may be installed at any other location provided that the sensor 1*a* is able to detect the internal pressure of the fuel vapor purge system. For example, the pressure sensor 1*a* may be installed within the canister 2.

While the fuel vapor purge system of the illustrated embodiment includes the ambient-air introduction control valve (13) and the ambient-air release valve (12) provided in the vicinity of the canister (2), the invention is also effectively applicable to a fuel vapor purge system having either one or neither of the ambient-air introduction control valve and ambient-air release valve.

While the invention is applied to a diagnostic operation to detect leakage in the purge path of the fuel vapor purge system in the illustrated embodiment, the invention may also be effectively applied to a diagnostic operation to detect or determine a failure in the purge control valve 11 or the pressure block valve 25*a*, for example.

In the illustrated embodiment, the diagnosis of the fuel vapor purge system, or leakage diagnosis, is performed by introducing a negative pressure into the purge path so as to create a pressure difference between the inside and the outside of the purge path. However, the leakage diagnosis may be executed by introducing a positive pressure (which is higher than the atmospheric pressure) into the purge path and measuring a degree or rate of reduction in the positive pressure.

The fuel vapor purge system of the aforementioned embodiment is constructed such that the fuel tank 1 is constantly held in communication with the canister 2. However, the invention may be embodied in the form of a fuel vapor purge system in which a tank pressure control valve is provided between the fuel tank and the canister, and a bypass passage is provided for communicating the fuel tank with the canister after and before introduction of a negative pressure into the purge path.

In the illustrated embodiment, the controller (the ECU 10) is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to preferred embodiments thereof, it is to be understood that the invention is not limited to the preferred embodiments or constructions. To the contrary, the invention is intended to cover various modifications and equivalent arrangements. In addition, while the various elements of the preferred embodiments are shown in various combinations and configurations, which are exemplary, other combinations and configurations, including more, less or only a single element, are also within the spirit and scope of the invention.

What is claimed is:

1. A diagnostic apparatus for a fuel vapor purge system in which fuel vapor generated in a fuel tank is trapped in a chamber, and the fuel vapor trapped in the chamber is purged into an intake passage of an internal combustion engine through a purge path that includes the fuel tank, the apparatus comprising:

a controller that:

measures a first change in an internal pressure of the purge path after creating a pressure difference between an inside and an outside of the purge path and sealing the purge path;

measures a second change in the internal pressure that varies with an amount of fuel vapor generated in the fuel tank, which second change is measured while the purge path is sealed for a first predetermined period of time after an atmospheric pressure is introduced into the purge path in which the pressure difference was created;

performs leakage diagnosis to determine whether leakage is present in the purge path, based on the first change and the second change in the internal pressure of the purge path;

measures a third change in the internal pressure that varies with an amount of fuel vapor generated in the fuel tank, prior to measurement of the first change and measurement of the second change, the third change in the internal pressure being measured while the purge path is sealed for a second predetermined period of time after an atmospheric pressure is introduced into the purge path before the pressure difference is created; and inhibits the leakage diagnosis when a result of measurement of the third change in the internal pressure is greater than a predetermined value, and permits the leakage diagnosis when the result of measurement of the third change is equal to or less than the predetermined value.

2. The diagnostic apparatus according to claim 1, wherein the second predetermined period of time is shorter than the first predetermined period of time.

3. The diagnostic apparatus according to claim 1, wherein the fuel tank and the chamber are interconnected via a passage so as to be always held in communication with each other.

4. The diagnostic apparatus according to claim 3, wherein the purge path is provided with a pressure block valve disposed in a passage through which ambient air is introduced into the chamber, and a purge control valve disposed in a passage through which the fuel vapor is purged from the chamber into the intake passage of the internal combustion engine, and wherein a pressure of the intake passage is introduced into the purge path when the pressure block valve is closed and the purge control valve is open, and the atmospheric pressure is introduced into the purge path when the pressure block valve is open and the purge control valve is closed, while the purge path is sealed when the pressure block valve is closed and the purge control valve is closed.

5. A method of diagnosing a fuel vapor purge system in which fuel vapor generated in a fuel tank is trapped in a chamber, and the fuel vapor trapped in the chamber is purged into an intake passage of an internal combustion engine through a purge path that includes the fuel tank, the method comprising the steps of:

measuring a first change in an internal pressure of the purge path after creating a pressure difference between an inside and an outside of the purge path and sealing the purge path;

measuring a second change in the internal pressure that varies with an amount of fuel vapor generated in the fuel tank, which second change is measured while the purge path is sealed for a first predetermined period of time after an atmospheric pressure is introduced into the purge path in which the pressure difference was created;

performing leakage diagnosis to determine whether leakage is present in the purge path, based on the first change and the second change in the internal pressure of the purge path;

measuring a third change in the internal pressure that varies with an amount of fuel vapor generated in the fuel tank, prior to measurement of the first change and measurement of the second change, the third change in the internal pressure being measured while the purge path is sealed for a second predetermined period of time after an atmospheric pressure is introduced into the purge path before the pressure difference is created; and inhibiting the leakage diagnosis when a result of measurement of the third change in the internal pressure is greater than a predetermined value, and permitting the leakage diagnosis when the result of measurement of the third change is equal to or less than the predetermined value.

6. The method according to claim 5, wherein the second predetermined period of time is shorter than the first predetermined period of time.

7. The method according to claim 5, wherein the fuel tank and the chamber are interconnected via a passage so as to be always held in communication with each other.

8. The method according to claim 7, wherein the purge path is provided with a pressure block valve disposed in a passage through which ambient air is introduced into the chamber, and a purge control valve disposed in a passage through which the fuel vapor is purged from the chamber into the intake passage of the internal combustion engine, and wherein a pressure of the intake passage is introduced into the purge path when the pressure block valve is closed and the purge control valve is open, and the atmospheric pressure is introduced into the purge path when the pressure block valve is open and the purge control valve is closed, while the purge path is sealed when the pressure block valve is closed and the purge control valve is closed.

* * * * *